US005671574A

United States Patent [19]

Long

[11] Patent Number: 5,671,574

[45] Date of Patent: Sep. 30, 1997

[54] COMPOSITE INSULATED WALL

[75] Inventor: Robert T. Long, Ames, Iowa

[73] Assignee: Thermomass Technologies, Inc., Ames, Iowa

[21] Appl. No.: 615,638

[22] Filed: Mar. 13, 1996

Related U.S. Application Data

[63] Continuation of Ser. No. 255,528, Jul. 26, 1994, abandoned.

[51] Int. Cl.[6] ..... E04C 2/22

[52] U.S. Cl. ..... 52/309.11; 52/410

[58] Field of Search ..... 52/309.7, 309.11, 52/309.17, 565, 568, 410, 426; 411/451

[56] References Cited

U.S. PATENT DOCUMENTS 2,412,744 12/1946 Nelson .
4,283,894 8/1981 Fricker et al. ..... 52/309.11 X
4,489,530 12/1984 Chang ..... 52/410 X
4,624,089 11/1986 Dunker ..... 52/309.11 X
4,829,733 5/1989 Long .
4,974,381 12/1990 Marks ..... 52/410 X
5,519,973 5/1996 Keith et al. ..... 52/309.11 X

*Primary Examiner*—Kien T. Nguyen
*Attorney, Agent, or Firm*—Hill, Steadman & Simpson

[57] ABSTRACT

An insulated wall includes first and second spaced apart layers of concrete having a layer of insulating material sandwiched therebetween. Extending through the insulative layer are a plurality of spike connectors having their opposite ends protruding into the two concrete layers and having their central portions extending through the insulating material. One of the opposite ends of the spike connectors is pointed so as to permit it to be punched through the insulative layer. The opposite ends of the spikes each include a holding surface facing at least partially toward the central insulative layer and holding the concrete layers against movement away from the insulative layer. C-shaped connectors may also be used in a similar fashion with hook ends hooked over elongated cables extending within the two concrete layers so as to tie them together.

2 Claims, 3 Drawing Sheets

COMPOSITE INSULATED WALL

This is a continuation of application Ser. No. 08/255,528, filed Jul. 26, 1994 now abandoned.

BACKGROUND OF THE INVENTION

This invention relates to a composite insulated wall and method for making same.

Insulated walls have been constructed in the prior art utilizing first and second concrete layers having an insulated layer sandwiched therebetween. Connectors or ties have been provided for extending through the concrete layers and the central insulating layer to connect them together. One type of connector has been made of metal or other material which is a high conductor of heat. When this type of connector is used, it forms a conduit for the passage of heat from one side of the wall to the other, and substantially reduces the effective R-value of the wall.

Fiber composite connectors having a high R-value have been used as shown in U.S. Pat. No. 4,829,733. The connector shown in this patent utilizies an elongated fiber member having blunt opposite ends. The insulation layer is provided with holes for receiving the connector so that the connector can be passed through the insulating layer with its opposite ends embedded in the two concrete layers.

Therefore, a primary object of the present invention is to provide an improved composite insulated wall and method for making same.

A further object of the present invention is the provision of an improved composite insulated wall utilizing a pointed plastic connector which can be punched through the insulative layer without requiring the formation of holes in the insulative layer.

A further object of the present invention is the provision of hook shaped plastic connectors having a high R-value, for connecting elongated reinforcing rods or strands extending through the concrete layers on opposite sides of the insulating layer.

A further object of the present invention is the provision of composite panels which do not bow or crack in response to temperature changes.

A further object of the present invention is the provision of a composite insulated wall and method for making same which involves simple construction techniques, and which is efficient in operation.

SUMMARY OF THE INVENTION

The foregoing objects are achieved by an insulated wall having first and second spaced apart layers of concrete with a layer of insulating material sandwiched therebetween. A plurality of elongated shear connectors made of plastic or other high R material extend through the layer of insulating material so that their opposite ends protrude into the layers of concrete. The opposite end portions of the shear connectors each have a holding surface which faces at least partially towards the insulating layer and which engages the first and second layers of concrete respectively to hold the first and second concrete layers against movement away from the insulating material. One end portion of each of the shear connectors has a pointed end which makes it possible to punch the connector through the insulating material during construction.

The method for making the composite wall involves taking the above described shear connector and punching the pointed end of the shear connector through the layer of insulating material to a position wherein the first and second end portions of the connector protrude outwardly from the opposite sides of the layer of insulation, and the central portion of the shear connector is within the layer of insulation. Next the first layer of concrete is poured and the layer of insulation material is placed on top of the poured layer before the concrete cures and hardens. The ends of the shear connector are pressed downwardly into the first layer of concrete so that the insulative layer abuts against the concrete. Next a second layer of concrete is poured over the upper surface of the insulation material so as to embed the other ends of the connectors in the second layer of concrete. When completed, and when the concrete has hardened, the holding surfaces of the opposite end portions of the shear connectors will hold the first and second concrete layers against movement away from the layer of insulating material.

In some applications, elongated strands of steel or other reinforcing material are placed within the first and second concrete layers and extend parallel to one another and to the central insulating layer. A hook connector having a central portion and first and second opposite hook shaped ends can be inserted through the insulating layer with the hook ends being hooked over cables on opposite sides of the insulating layer. The hook connector can be C-shaped, or can be shaped into a loop, with a slot formed in one of the loop sides so as to permit the device to be hooked over the two cables or strands in the first and second layers.

DESCRIPTION OF THE PREFERRED EMBODIMENTS

Figure 1:
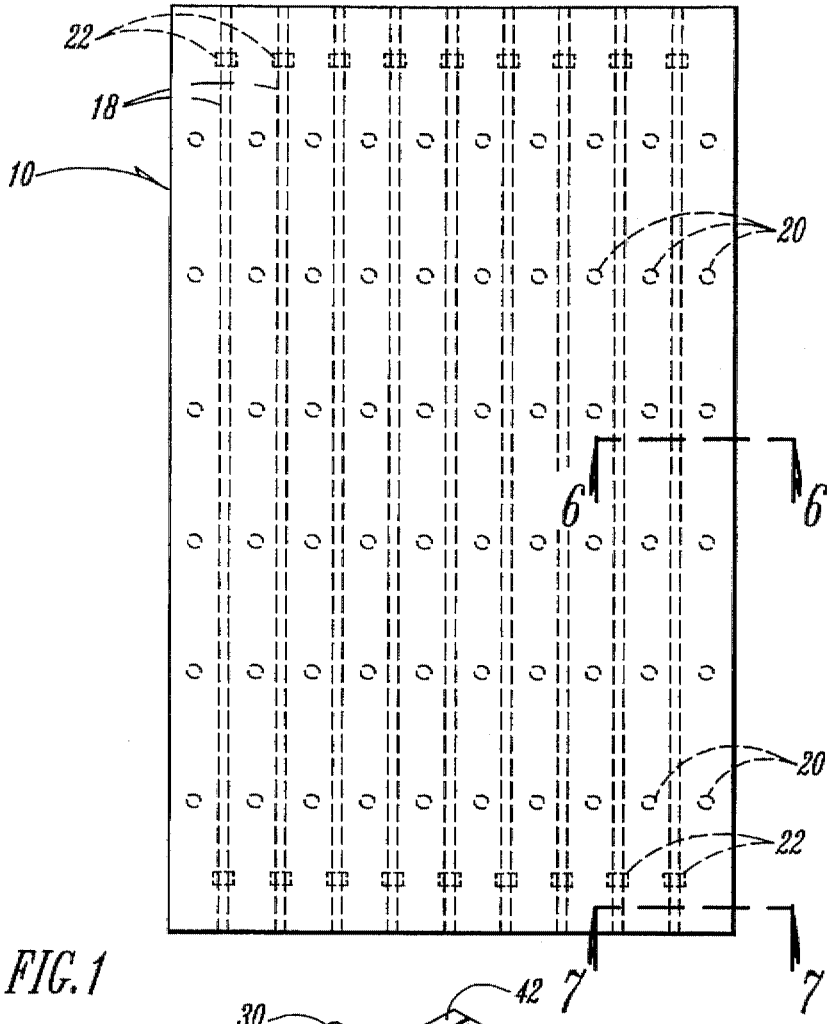
FIG. 1 is a plan view of an insulated wall made according to the present invention.
Figure 2:
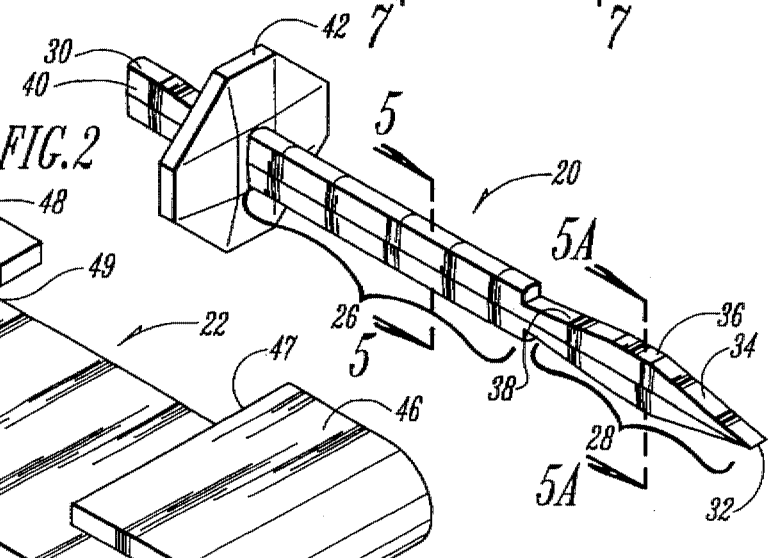
FIG. 2 is a perspective view of one of the connectors of the present invention.

Referring to the drawings, the numeral 10 generally designates a composite wall made according to the present invention. The composite wall 10 includes a first concrete layer 12 and a second concrete layer 14 which have an insulating layer 16 sandwiched therebetween. The insulative layer 16 may be formed from insulation board commonly used in the construction industry. Its thickness may vary as desired, but preferably it is of a rigid shape so that it will hold its own shape. Extending along the vertical length of the concrete layers are a plurality of elongated reinforcing members or stress strands 18 which are embedded in each of the two concrete layers 12, 14. These stress strands 18 are parallel to one another and are also parallel to the insulation board 16.

Extending through the insulation board 16 are a plurality of spike connectors 20 and C-shaped hook connectors 22. Alternatively, a pluarlity of loop shaped hook connectors 24 can be used in lieu of the C-shaped hook connectors 22.

Figure 5:
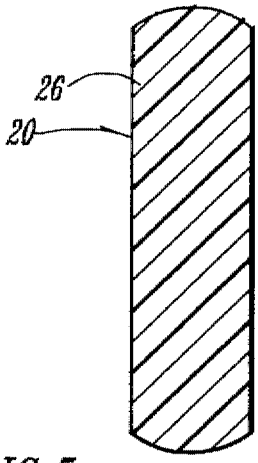
FIGS. 5 and 5A are sectional views taken along lines 5—5 and 5A—5A of FIG. 2.
Figure 5A:
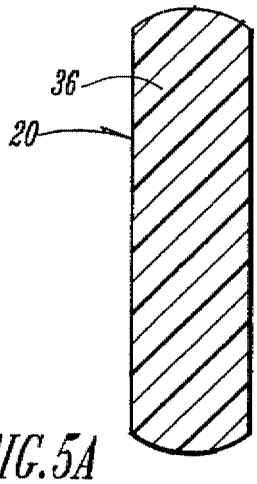

Each spike connector 20 includes a central portion 26, a pointed end portion 28, and a blunt end portion 30. The pointed end portion 28 includes a point 32 and a point taper 34 which tapers outwardly therefrom to a wide portion 36. As can be seen in FIGS. 5 and 5A, the cross-sectional size and shape of the wide portion 36 is approximately the same as the cross-sectional size and shape of the central portion 26. While the shape of these two portions is shown to be approximately rectangular, other shapes may be used without detracting from the invention.

A holding surface 38 is formed on the end portion 28 and faces at least partially toward the central portion 26 of the spike connector 20. The holding surface 38 is shown in the drawings to be tapered, but it could also be perpendicular to a longitudinal axis of the spike connector 20. It is important, however, that the holding surface 38 face at least partially toward the central portion 26 so that it can engage concrete in one of the concrete layers 12, 14 and hold the concrete layer to the insulative layer as will be described hereafter. The blunt end portion 30 also includes a similar holding surface 40. A flange 42 is attached to the spike connector 20 and is positioned between the blunt end portion 30 and the central portion 26. While the flange 42 is preferred for use with the spike connector 20, it is possible to use the spike connector 20 without having any flange 42 thereon.

Figure 3:
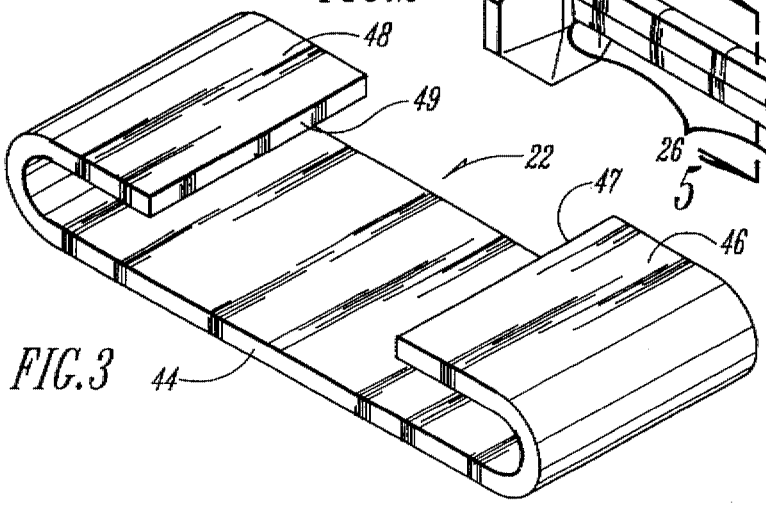
FIG. 3 is a perspective view of the C-shaped connector used in the present invention.

Referring to FIG. 3, the C-shaped hook connector 22 includes a central portion 44, a first hook end 46 and a second hook end 48. The hook ends 46, 48 each have hook tips 47, 49 respectively which are spaced apart a distance slightly greater than the thickness of the insulative board 16.

Figure 4:
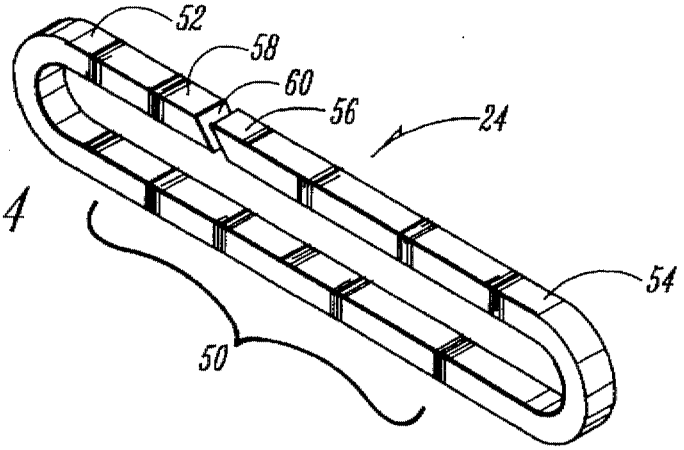
FIG. 4 is a perspective view of a loop-shaped connector of the present invention.

Referring to FIG. 4, the loop shaped hook connector 24 includes a central portion 50, a first hook end 52, and a second hook end 54. The hook ends 52, 54 each include hook tips 56, 58 respectively which are spaced a short distance apart to form a slot 60.

Figure 6:
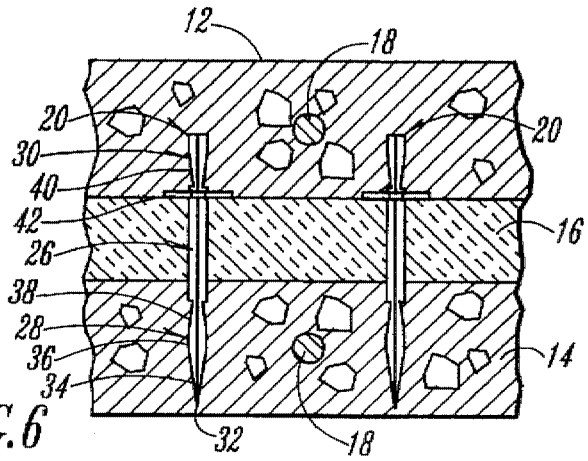
FIG. 6 is a sectional view taken along lines 6—6 of FIG. 1.
Figure 7:
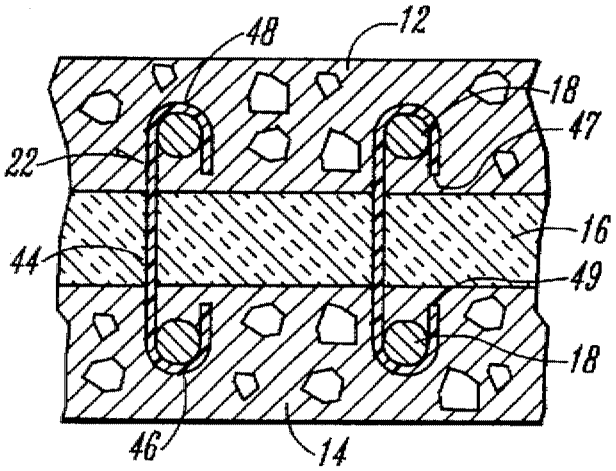
FIG. 7 is a sectional view taken along lines 7—7 of FIG. 1.

The method of construction is as follows: first a form is made for one of the layers 12, 14 of concrete, and concrete is poured into that layer. Next a plurality of spike connectors 20 are punched through the insulation board, using the sharp pointed end 32 to permit the spike connector 20 to punch through the softer insulation material. The fact that the wide portion 36 has approximately the same size and cross-sectional shape as the central portion 26, permits the pointed end portion 28 to form a hole in the insulation board which permits the entry of the central portion 24. When using spike connectors 20 having the flange 42, the spike connectors 20 are inserted until the flange 42 abuts against the insulation board 16 as shown in FIG. 6. In this position, the blunt end portions 30 are protruding above the insulation board, and the pointed end portions 26 are protruding downwardly through an opposite side of the board 16.

Assuming that concrete layer 14 is the first layer to be poured, the insulation board 16 is placed over the layer 14 before the concrete cures or hardens, and the pointed portions 26 of the connectors 20 are forced downwardly into the concrete layer 14 and become imbedded therein as shown in FIG. 6.

Next, the concrete layer 12 is formed and poured above the insulative board 16 so that it completely surrounds and covers the blunt end portions 30 of each of the connectors 20.

When the concrete of layers 12 and 14 cures and hardens, it holds the layers 12, 14 tightly against the insulation board 16 by virtue of the holding surfaces 38 on the connectors 20. It is possible to use the spike connectors 20 with or without the flange 42, but it is important that the end portions 26, 30 protrude outwardly beyond the opposite sides of the insulative board 16 and into the concrete layers 12, 14.

It is also possible to use the C-shaped connectors 22 during the formation of the insulated wall. When the connectors 20 are used, they are inserted through the insulation board 16. This may be done by inserting them through preformed holes in the insulation board 16, or holes can be punched to permit the insertion of these C-shaped connectors 22. When the insulation board 16 is placed over the as yet uncured concrete layer 14, the hook ends 48 are hooked over the strands or cables 18 which extend through the concrete layer. Then, when the upper layer 12 is poured and the strands 18 are placed therein, the upper hook portions 48 are hooked over the cables 18 so as to secure the cables 18 in the layer 12 to the cables 18 in the concrete layer 14.

Figure 8:
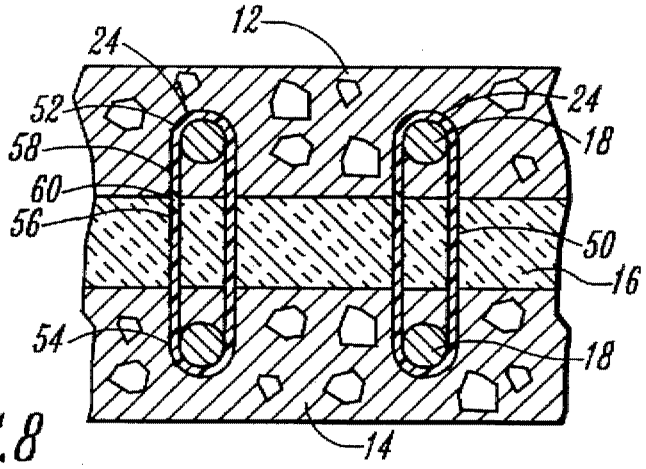
FIG. 8 is a sectional view similar to FIG. 7, but showing the loop connectors in the place of the C-shaped connectors.
Figure 9:
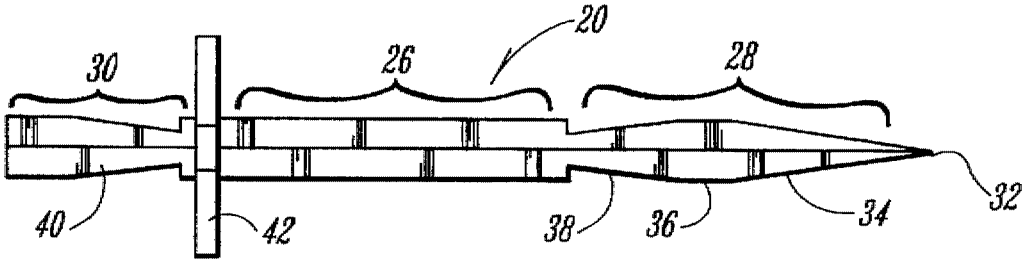
FIG. 9 is a elevational view of the spike connector shown in FIG. 2.

FIG. 8 shows a similar construction utilizing the loop shaped connectors 24 in the place of the C-shaped connectors 22. Both the C-shaped connectors 22 and the loop shaped connectors 24 are formed of plastic fiberous material which has a high R-value. Also the loop shaped connector 24 is flexible so that the hook tips 56, 58 may be pried apart slightly so as to permit the loop to be hooked around the cables 18 as shown in FIG. 8.

Because the connectors 20, 22, 24, are all made of high R material such as fiberglass or other plastic material, there is a complete thermal barrier between the two concrete layers 12, 14. This is to be contrasted with many prior art devices which utilize metal connectors capable of providing a thermal conduit between the two concrete layers. The various connectors 20, 22, 24 may be used in a variety of combinations so as to minimize the cracking or bowing of the composite panels in response to temperature changes.

In the drawings and specification, there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

I claim:

1. An insulated wall comprising: first and second spaced apart layers of concrete; a layer of insulating material sandwiched between said first and second layers of concrete; a plurality of elongated shear connectors having a high R-value, and extending through said layer of insulating material; each of said shear connectors comprising a first end portion extending into said first layer of concrete, a second end portion extending into said second layer of concrete, and a central portion extending through and within said layer of insulating material; said first and second end portions of said shear connectors each having, respectively, a holding surface facing at least partially toward said insulating layer and engaging said first and second layers of concrete, respectively, to hold said first and second layers of concrete against movement away from said layer of insulating material wherein said first end portion, said second end portion and said central portion are integrally formed having a uniform width from the first end portion to the second end portion inclusively; said second end portions of each of said shear connectors having a pointed end and tapering outwardly toward said layer of insulation to a wide point having a cross-section approximately the same in shape and size as the cross-section of said central portion; said wide point located between said holding surface and said pointed end of said second end portion and further wherein said holding surface of said second end portion tapers inwardly and uniformly from the wide point to the central portion; wherein each of said first, second, and central portions of each of said shear connectors has a longitudinal axis, said longitudinal axes of said first, second, and central portions extending in the same direction; further comprising a hook connector made of a high R-value material and having a central portion and first and second opposite hook shaped ends, said central portion of said hook connector extending through said layer of insulating material and said first and second opposite hook shaped ends embedded in said first and second layers of concrete respectively; wherein a first and a second elongated member are within said first and second layers of concrete respectively and extend parallel to said insulating material, said first and second hook shaped ends of said hook connector hooked over said first and second elongated members respectively; and further wherein said first and second hook shaped ends extend partially into said layer of insulating material and are separated by a narrow gap.

2. An insulated wall comprising: first and second spaced apart layers of concrete; a layer of insulating material sandwiched between said first and second layers of concrete; a plurality of elongated shear connectors having a high R-value, and extending through said layer of insulating material wherein said first end portion, said second end portion and said central portion are integrally formed having a uniform width from the first end portion to the second end portion inclusively; each of said shear connectors comprising a first end portion extending into said first layer of concrete, a second end portion extending into said second layer of concrete, and a central portion extending through and within said layer of insulating material; said first and second end portions of said shear connectors each having, respectively, a holding surface facing at least partially toward said insulating layer and engaging said first and second layers of concrete, respectively, to hold said first and second layers of concrete against movement away from said layer of insulating material; said second end portions of each of said shear connectors having a pointed end and tapering outwardly toward said layer of insulation to a wide point having a cross-section approximately the same in shape and size as the cross-section of said central portion; said wide point located between said holding surface and said pointed end of said second end portion and further wherein said holding surface of said second end section tapers inwardly and uniformly from the wide point to the central portion; wherein each of said first, second, and central portions of each of said shear connectors has a longitudinal axis, said longitudinal axes of said first, second, and central portions extending in the same direction; further comprising a hook connector made of a high R-value material and having a central portion and first and second opposite hook shaped ends, said central portion of said hook connector extending through said layer of insulating material and said first and second opposite hook shaped ends embedded in said first and second layers of concrete respectively; wherein a first and a second elongated member are within said first and second layers of concrete, respectively, and extend parallel to said insulating material, said first and second hook shaped ends of said hook connector hooked over said first and second elongated members respectively; and further comprising a flange rigidly connected to each of said shear connectors and bearing against said layer of insulating material between said insulating material and said first layer of concrete.

* * * * *